US005517884A

United States Patent [19]

Sanders

[11] Patent Number: 5,517,884

[45] Date of Patent: May 21, 1996

[54] RATCHET SPEED WRENCH HANDLE

[76] Inventor: Alton W. Sanders, 628 S. Durland, Oklahoma City, Okla. 73109

[21] Appl. No.: 406,232

[22] Filed: Mar. 1, 1995

Related U.S. Application Data

[63] Continuation-in-part of Ser. No. 238,649, May 5, 1994, abandoned.

[51] Int. Cl.[6] ..... B25B 13/46; B25G 1/04

[52] U.S. Cl. ..... 81/60; 403/102; 81/177.2; 81/177.7

[58] Field of Search ..... 81/177.2, 177.7, 81/177.8, 60–63.2; 403/102, 84

[56] References Cited

U.S. PATENT DOCUMENTS

| | | | |
|---|---|---|---|
| 1,080,121 | 12/1913 | Oriol | 81/177.7 |
| 1,743,241 | 1/1930 | Schmidt | 403/102 |
| 2,182,673 | 12/1939 | Magnano | 81/177.7 |
| 2,869,410 | 1/1959 | Prichard | 81/177.2 |
| 2,978,938 | 4/1961 | Nalley | 81/177.7 |
| 3,186,265 | 6/1965 | Wenturine et al. | 81/177 |
| 4,334,445 | 6/1982 | Timewell | 81/177 |
| 4,711,145 | 12/1987 | Inoue | 81/177.1 |
| 4,794,829 | 1/1989 | Mesenhoeller | 81/177.8 |
| 4,991,470 | 2/1991 | Singleton | 81/177.7 |
| 5,280,740 | 1/1994 | Ernst | 81/177 |

*Primary Examiner*—Bruce M. Kisliuk
*Assistant Examiner*—Joni B. Danganan
*Attorney, Agent, or Firm*—Robert K. Rhea

[57] ABSTRACT

A speed wrench is formed by threadedly connecting a handle extension to the end of a ratcheting wrench handle opposite the wrench head for increasing torque of the handle. The wrench handle opposite the head is centrally bored for slidably receiving a rod member hingedly connected with the handle extension permitting the handle extension to be disposed normal to the longitudinal axis of the handle and moving the wrench handle in speed wrench fashion through a selected arc in tightening or loosening a nut.

4 Claims, 1 Drawing Sheet

FIG. 1
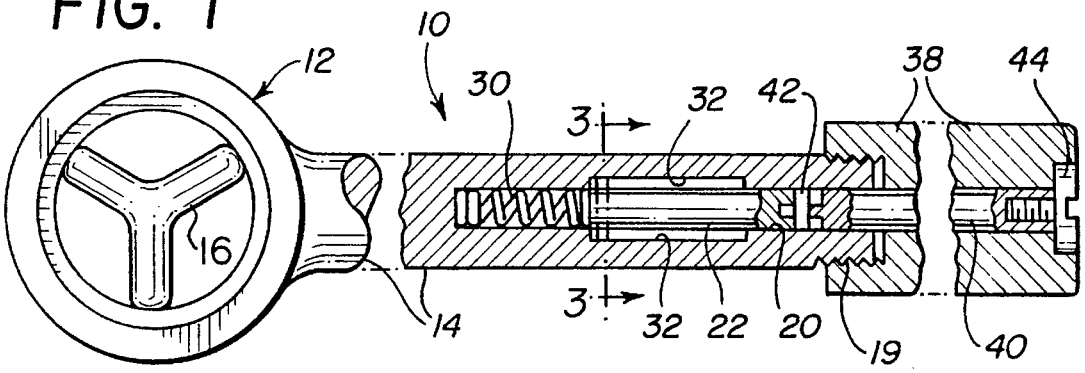
FIG. 3
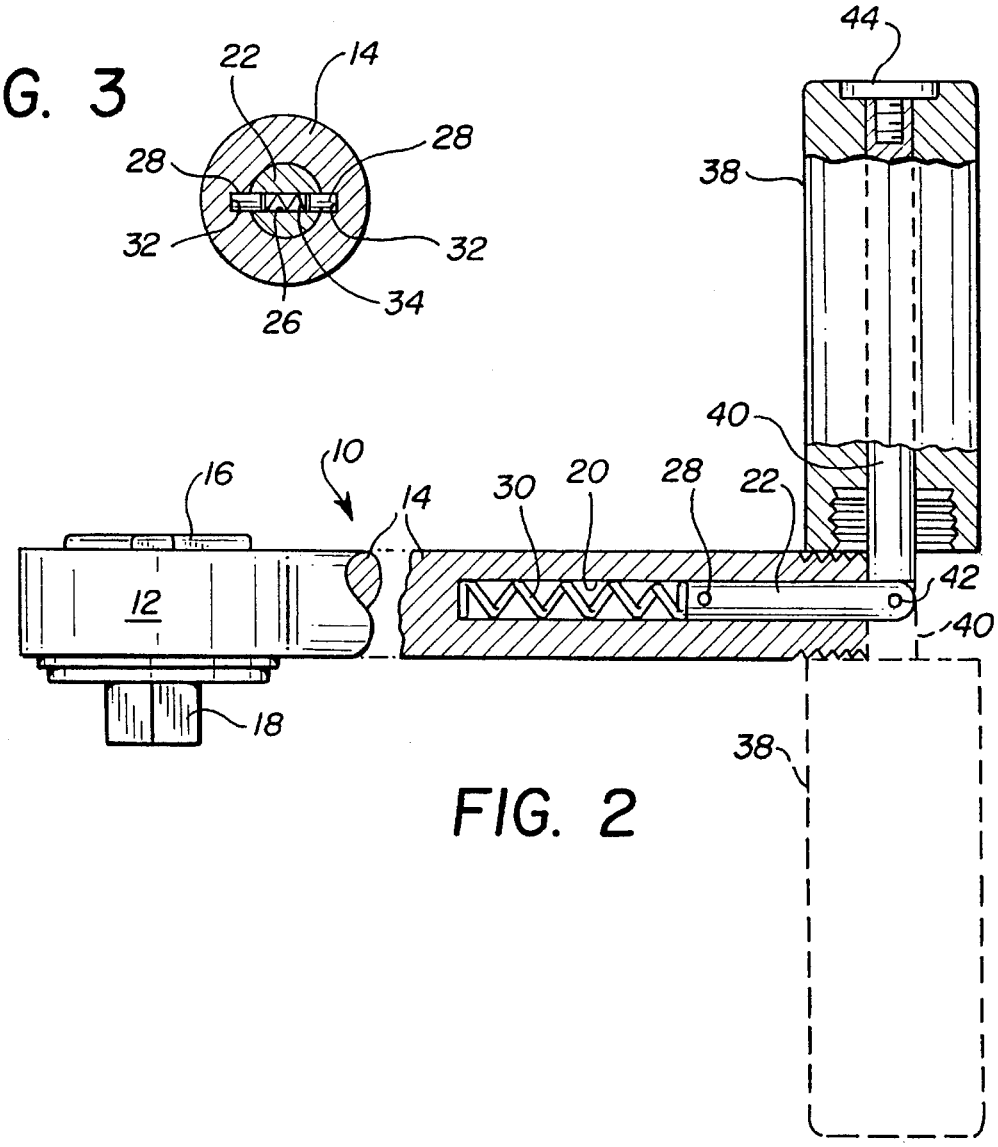
FIG. 2

RATCHET SPEED WRENCH HANDLE

CROSS REFERENCE TO RELATED APPLICATION

This application is a continuation-in-part of an application filed by me in the United States Patent and Trademark Office on May 5, 1994, Ser. No. 08/238,649 for SPEED RATCHET now abandoned.

BACKGROUND OF THE INVENTION

1. Field of the Invention

This invention relates to ratchet wrenches and more particularly to an extendable handle forming a speed wrench.

It is often necessary to remove and then reinstall a series of fasteners such as threaded bolts to remove an automotive oil pan. Some torque is needed to initially loosen the bolts and similarly to retighten them wherein the bolt must be turned a number of times to remove it from a fastening position and similarly to reinstall the bolt before tightening it to its final position.

The confined area of the bolts frequently preclude the use of the mechanic's hands or fingers in removing the loosened bolts or installing them when replacing the bolts and is accomplished by a ratchet wrench when the bolts threaded condition is such that it requires the wrench to be used. The back and forth action of the ratchet handle in removing or installing the bolt is a tedious operation. Thus, the need arises in which a simple relatively inexpensive tool for rapid insertion or removal of nuts and screws, or the like, which does not require external electrical power. This invention provided such a ratchet wrench.

2. Description of the Prior Art

U.S. Pat. No. 4,711,145 issued Dec. 8, 1987 to Inoue for RATCHET HANDLE and U.S. Pat. No. 4,794,829 issued Jan. 3, 1989 to Mesenhoeller for RATCHET-TYPE WRENCH each disclose a socket ratcheting wrench head hingedly connected with a handle for pivoting movement of the handle relative to the head about the axis of the hinge pin. Both of these patents feature serrations on the ratchet head at the round part of the hinged position and a cooperating ratchet tooth equipped catch member moved into locking relation with the teeth serrations by the handle. The catch member in the Inoue patent is spring biased into engagement with the serrated teeth.

U.S. Pat. No. 5,280,740 issued Jan. 25, 1994 to Ernst for FLEXIBLE HEAD SOCKET WRENCH similarly features a ratcheting socket driving wrench head hingedly connected to a handle in which the preferred embodiment of this invention features a ratcheting member in the handle which permits angular rotation of the ratchet about its longitudinal axis which is useful in angularly rotating a socket about a bolt axis when the handle is disposed with its axis parallel to the axis of a bolt or nut being tightened or removed.

U.S. Pat. No. 3,186,265 issued Jun. 1, 1965 to Wenturine et al for WRENCH HAVING ANGULARLY ADJUSTABLE AUXILIARY HANDLES and U.S. Pat. No. 4,334,445 issued Jun. 15, 1982 to Timewell for Z-STYLE SPEED WRENCH both disclose plural handle members connected with a socket driving ratcheting wrench head by a pair of hinge connections in which the axis of the hinged pins are parallel. The joint structure of the Wenturine patent features notches and spring urged ball detents for disposing the handle members in flattened Z-shape position which maintains the handle in a selected position while applying torque to the wrench head in which the handle portion is restricted relative to its normal position relative to the wrench head. The Timewell patent socket drive end axially connects a socket with the handle axis so that the handle members may be disposed relative to the socket wrench head in angular positions and utilized as a speed wrench for rapid rotation of a bolt or nut about the axis of a bolt.

This invention is believed distinctive over the above named patents by threadily connecting a tubular member to the end of a ratchet wrench handle opposite the wrench head for increasing torque leverage of the handle. The wrench handle opposite the head is centrally bored for slidably receiving a rod member hingedly connected with the handle extension permitting the wrench handle extension to be disposed normal to the longitudinal axis of the handle and moving the wrench handle through a selected arc in tightening or loosening a nut.

SUMMARY OF THE INVENTION

A ratchet speed wrench is formed by a reversible ratchet wrench head having a socket drive and a laterally projecting handle.

The end of the handle opposite the wrench head is exteriorly threaded and centrally bored a selected depth for slidably receiving an extension rod normally urged outwardly of the bore by an expansion spring. An extension handle is mounted on a second rod extension pivotally connected with the first rod extension opposite the spring and journals a speed wrench extension handle normally threadily connected at one end with the wrench handle to increase the torque applied to the wrench head.

The wrench extension handle may be disconnected from the ratchet handle and turned upwardly or downwardly, normal with respect to the longitudinal axis of the ratchet wrench handle, to act as a speed wrench by rotation in either direction about the axis of the wrench head or moved to-and-fro during ratcheting movement of the ratchet head.

The principal object of this invention is to increase the length of a ratchet wrench handle by adding an auxiliary handle thereto which may be pivoted upwardly or downwardly with its axis normal to the wrench handle and rotate rapidly about the axis of the wrench head.

BRIEF DESCRIPTION OF THE DRAWINGS

FIG. 1 is a fragmentary top view partly in section;

FIG. 2 is a fragmentary side view, partially in section, illustrating the tool handle in speed wrench position by solid and dotted lines; and, FIG. 3 is a vertical cross sectional view taken substantially along the line 3—3 of FIG. 1.

DESCRIPTION OF THE PREFERRED EMBODIMENTS

Like characters of reference designate like parts in those figures of the drawings in which they occur.

The reference numeral 10 indicates the speed wrench as a whole having a reversible ratchet wrench head 12 and a laterally projecting handle 14. The wrench head 12 is conventionally provided with a ratchet direction control 16 and a diametrically opposite wrench socket driver 18.

The end of the handle 14 is exteriorly threaded, as at 19, and the handle is centrally bored from its end opposite the wrench head a selected depth as at 20 for slidably receiving a first handle extension rod 22 having an expansion spring 30 interposed between the inward end of the rod 22 and the inward end of the bore 20 for the purposes presently explained.

Adjacent its inward end the first rod extension 22, is transversely bored as at 26 for slidably receiving one end portion of a pair of rod stops 28 biased outwardly by an expansion spring 34 interposed between the inward ends of the stops 28.

A pair of longitudinally extending diametrically opposite grooves 32 are formed on the wall defining the bore 20 for cooperatively slidably receiving the outwardly disposed end portions of the rod stops 28 and limiting the longitudinal sliding movement of the rod 22 relative to the handle 14 for the reasons presently believed apparent.

A cylindrical extension handle 38 having a larger diameter than the wrench handle 14 is journalled by a second extension rod 40 hingedly connected by hinge pin 42 with the first rod extension 22. The handle 38 is maintained on the rod 40 by a screw 44 threadedly connected with the rod 40.

The end of the handle extension 38 adjacent the wrench handle is counterbored and internally threaded for cooperatively receiving the wrench handle threads 19, thus, lengthening the effective length of the wrench handle 14 for applying greater torque to a nut or bolt in a wrench tightening or loosening action.

Operation

When a bolt or nut has been loosened by the wrench 10, but is still to tight to manually continue further rotation thereof the handle extension 38 may be unscrewed from the wrench handle 14 and the rod extension 22 pulled outwardly of the wrench handle 14, assisted by the spring 30. The handle extension may be turned upwardly, normal to the longitudinal axis of the handle 14, or downwardly as illustrated by broken lines so that the operator may use the handle extension 38 in a speed wrench action of rotating the wrench handle about the axis of the wrench head or holding the handle 38 and in either the upward solid line or downward broken line position and moving the wrench handle 14 in a to-and-fro direction.

Obviously the invention is susceptible to changes or alterations without defeating its practicability. Therefore, I do not wish to be confined to the preferred embodiment shown in the drawings and described herein.

I claim:

1. A handle extension for a ratchet wrench head having a driver and having a wrench head handle axially bored a selected depth at its end portion opposite the wrench head, comprising:

a first rod longitudinally slidable in the wrench head handle bore;

a second rod pivotally connected at one end portion with said first rod and projecting at its other end portion beyond said wrench head handle opposite the wrench head; and, a cylinder journalled by said second rod and axially connected with said wrench head handle when in one position and axially disposed normal to the wrench head handle when in a second position.

2. The handle extension according to claim 1 in which the wall forming the wrench head handle bore is provided with a longitudinally extending slot intermediate the depth of the bore, and further including:

a spring biased stop projecting radially outwardly from the inwardly disposed end portion of said first rod for maintaining one end portion of said first rod within the wrench head handle bore.

3. The handle extension according to claim 2 and further including:

a spring interposed between the inward end of the wrench head handle bore and the adjacent end of said first rod for biasing the other end portion of said first rod outwardly of the wrench head handle bore.

4. The handle extension according to claim 3 in which the end portion of the wrench head handle opposite the wrench head is exteriorally threaded and the adjacent end portion of the cylinder is counterbored and threaded for threadedly receiving the wrench head handle; and, a screw secured to the end portion of said second rod for maintaining said cylinder on said second rod.

* * * * *